US006018916A

United States Patent [19]

Henry

[11] Patent Number: 6,018,916

[45] Date of Patent: Feb. 1, 2000

[54] DOOR AND WINDOW SHIM

[76] Inventor: Mark Henry, 1941 W. Houston Apt. 7, Broken Arrow, Okla. 74014

[21] Appl. No.: 09/153,561

[22] Filed: Sep. 15, 1998

[51] Int. Cl.[7] ..... E06B 1/02; B66F 13/00

[52] U.S. Cl. ..... 52/126.1; 52/211; 52/213; 52/215; 52/217; 52/656.2; 49/505; 254/104

[58] Field of Search ..... 254/104; 52/213, 52/215, 217, 126.1, 126.3, 126.5, 656.2, 656.4, 656.5, 749.1, 745.16, 745.2, 211; 49/505, 504

[56] References Cited

U.S. PATENT DOCUMENTS

| | | | |
|---|---|---|---|
| 2,239,433 | 4/1941 | Urbain . | |
| 2,300,485 | 11/1942 | Bristow | 52/126.3 X |
| 2,651,814 | 9/1953 | Lester, Jr. | 49/505 |
| 2,753,602 | 7/1956 | Ringle | 52/127.1 X |
| 2,865,060 | 12/1958 | Pattiani . | |
| 2,914,817 | 12/1959 | Jackson . | |
| 2,997,750 | 8/1961 | Lester, Jr. | 52/217 X |
| 3,171,632 | 3/1965 | Jines . | |
| 3,345,780 | 10/1967 | McGhee | 52/213 X |
| 4,135,335 | 1/1979 | Jensen | 52/126.1 |
| 4,713,922 | 12/1987 | Ingold . | |
| 4,731,965 | 3/1988 | Jensen . | |
| 4,819,392 | 4/1989 | Day | 254/104 X |
| 4,924,642 | 5/1990 | Juell . | |
| 5,054,250 | 10/1991 | Foss . | |
| 5,566,414 | 10/1996 | Nonaka | 254/104 X |
| 5,775,036 | 7/1998 | Stanley, Sr. | 52/127.2 |

FOREIGN PATENT DOCUMENTS

| | | | |
|---|---|---|---|
| 806132 | 6/1951 | Germany | 254/104 |
| 1946254 | 4/1970 | Germany | 52/126.5 |
| 2347266 | 4/1975 | Germany | 52/211 |
| 8105414 | 6/1983 | Netherlands | 52/238.1 |
| 2251261 | 7/1992 | United Kingdom | 52/213 |

*Primary Examiner*—Laura A. Callo

[57] ABSTRACT

A door and window frame adjusting shim sized to fit all common interior or exterior prehung doors and framed windows, preferably factory pre-mounted to the prefabricated door or window casing, comprised of a flat mounting plate and two attached interlocking nested wedge shaped portions, to provide a carpenter or homeowner with a functional, reliable and inexpensive installation shim method, the adjusting shim permits rapid positioning of the door or window, and is especially useful when installing multiple doors and windows into a building.

2 Claims, 3 Drawing Sheets

DOOR AND WINDOW SHIM

FIELD OF THE INVENTION

The present invention relates to the mounting of door or window units in the rough framed opening of a building wider construction or remodel. More particularly, the invention pertains to a two-part wedge type take up spacer for adjustably locating a prefabricated door or window within a rough opening. In the construction of buildings in which prefabricated doors or windows are to be installed in wall openings, the contractor provides rough openings according to the architectural specifications. The trim carpenters will then install the necessary frames in the rough openings and ultimately hang the doors and windows. It is essential that the door frames consisting of the side jambs be properly installed in order to have a properly fitted door. This means that during construction, the door jambs must be perfectly plumb, and the frame must be perfectly square. Usually, this is accomplished by accepting an assembled frame from the supplier having the proper dimension, and placing it within the rough opening.

During installation, the door or window frame is held plumb and stationary prior to nailing with use of spacers or wedges (shims) placed between the rough framed opening and the prefabricated door or window frame. The shims adjust the jamb to plumb positions. Thus, by a manual positioning of various wedge combinations, the frame can be eventually positioned and nailed in place.

Mounting requires careful adaptation and much manipulation if the fasteners are to exert required holding force without deformation and bending of the door frame. Even a skilled carpenter requires a fair amount of time to install a door frame in a rough opening, due to the necessity of locating and placing the shims to accommodate plumbing the door frame. Often, scraps of wood, or shingles are used for this purpose. However, it is often tedious and difficult to find a shim piece of the desired size and shape to achieve the correct spacing. Some carpenters whittle shims from construction scrap or any bits or pieces of wood found on the building site, or modify existing shim stock to fit their present need.

The present invention is directed to an installation method and door or window frame which provides a fast and accurate way to install a prefabricated door or window unit. The present invention is used to increase the speed and accuracy of an installation by a skilled carpenter, but it will also allow less experienced persons to properly install the door or window frame.

The present device may be manufactured in a simple and inexpensive manner, and the device can be mounted rapidly preferably during manufacture of the door or window casing. Although the preferred width intended for the present shim is 3½ inches, it may be constructed in various widths to accommodate different door or window casing widths. The present invention embodies a two-part wedge-type spacing assembly comprising a tapered base portion and a complemental slide portion thereupon. The base and slide are formed with interlocking guiding means. In it's most basic form, the present invention is comprised of 2 parts, plastic or wood composite:

Part 1, the base, is a 4½ inch square, 1/16 inch thick plastic panel, sized to fit the width dimension of a standard door or window casing. The base panel is provided with a fixed integral wedge mounted upon the outward face. The integral wedge is ideally 3½ inches in width, centered upon the plastic panel, tapering in thickness from ¼ inch to 1/64 inch.

The fixed integral wedge has a series of aligned channels provided upon its contact face. One or more of the channels serve as forward travel guides and one or more channels serve as receptacles for a snap-in locator/hold-down detent tab. The fixed integral wedge is provided with a flattened face upon the thick end. The flattened face serves as a travel stop.

Part 2 of the present invention is a tapered moveable wedge, which is 3½ inches in width, tapering in thickness from ¼ inch to 1/64 inch, and the moveable wedge is provided with one or more furrow follower projections upon its contact face, and one or more snap-in locator/hold-down detent lugs are presented upon its contact face. The moveable wedge is assembled to reside atop the contact face of the fixed wedge, and the furrow follower projections on the moveable wedge fit into furrows present on the fixed wedge contact face. The snap-in locator/hold-down detent lug holds the moveable wedge upon the fixed wedge, and allows for controlled forward/reverse travel of the moveable wedge. The flattened face of the fixed wedge serves as a forward travel stop for the moveable wedge. Preferably, the shim assembly is affixed to the outside of a common prefabricated door/window casing during manufacture, using staples as is common in the art. A series of 6 or more shim assemblies is utilized on each door/window casing to perform the necessary shim function.

To meet this requirement, a minimun of two shim assemblies are placed upon each leg of the casing; a set of two or more shim assemblies upon the casing header, two or more shim assemblies upon the casing sill, two or more shim assemblies upon the casing right riser, and two or more shim assemblies upon the casing left riser.

Each panel is labeled and identified with a 'THIS END UP' mark, identifying which end of the panel is to be installed upwardly. Thereby, the moveable wedge upon the riser portion will be moveable downwardly, which allows gravity to hold the wedge during adjustment for ease of installation.

Various types of prefabricated wedges and shims have been developed for this purpose, some of which are effective but too costly, and others which are inexpensive, but limited in usefulness, and others which involve premachining the jamb or building framing. Other previous techniques of providing for shim structures for use in a building structure are illustrated by the prior art references following. Included among these techniques are those which utilize a plurality of breakaway shims in the assembly disclosed in U.S. Pat. No. 4,713,922 by John P. Ingold; the metallic interlocking shim structure as is found in the U.S. Pat. No. 2,239,433 of Leon F. Urbain; the rabbetted door casing with removable shim array described in the U.S. Pat. No. 2,914,817 issued to Edwin T. Jackson; the bolt driven double wedge of U.S. Pat. No. 3,171,632 by Sidney M. Jines; and the flexible shim array as used on windows, illustrated in U.S. Pat. No. 5,054,250 by Robert. E Foss. Further illustrative of such shim techniques are; the adjustable shim of Brian A. Jensen, described in U.S. Pat. No. 4,731,965; the spring steel shim and install tool apparatus disclosed by Per A. Juell in U.S. Pat. No. 4,924,642; the rabbetted door framing and spacer block found in U.S. Pat. No. 2,865,060 by Alois W. Pattiani; and the molded door jamb and moveable block apparatus outlined in the U.S. Pat. No. 3,345,780 of Thomas B. McGhee.

None of these devices have come into popular use in the trades due to the reasons that include the difficulties described above. It is recognized that various well known expedients, including shims and sliding single wedges have been used previously, and that their usage has not always conveniently produced uniformly satisfying and permanent results. The novel shim assembly embodying the present invention avoids the difficulties indicated above and affords other features and advantages, not heretofore obtainable.

BACKGROUND OF THE INVENTION

The present invention contemplates a new and improved shim structure of the type described above which provides the installer an enhanced utility of use, and primarily comprises a shim tool having a flat mounting plate portion and a pair of attached identical co-acting wedges.

It is among the objects of this invention to provide a system by which a prefabricated door or window unit may be accurately set within a rough framed opening in a building wall or partition. Disclosed by the applicant to the PTO on Mar. 25, 1998 in a package submitted wider the Disclosure Document Program, Ser. No. 434,748 it is a primary object of die present invention to overcome deficiencies in present construction techniques and the prior art methods of providing door and window shim structures by now furnishing a two part shim system to be used on prefabricated door and window casings and the like, and the shim system is permanently anchored to the door or window casing at the factory and is readily nailable through along the entire length, to support and anchor the door or window casing upon installation at the building.

The invention provides for the application of a two-piece double wedge shim structure to the prefabricated door or window jamb. The two-piece adjustable shim includes a base member and a slide member. The base member is preferably formed of a flat piece of plastic wood composite approximately 1/16 inch thick, and the base member has an integral wedge permanently mounted to it. The slide member is also preferably formed of plastic wood composite, and is also wedge shaped and is slideably interlocked and installed parallel atop the wedge portion of tie base member. Each wedge member is the same general shape as the other. Each wedge member presents a tapered slope part to co-act and mate with the opposed member to provide an expandable shim which will allow for the adjustment necessary to install the door or window unit correctly.

This invention allows for infinite adjustment within the size limits of the co-acting member wedges. The invention is an improved tool which can be used with conventional construction methods, without modifying door or window installation technique.

The principal object of the invention is to provide a method by which a prefabricated door or window frame can be accurately and rapidly positioned in a rough opening within a building wall.

Another object of the invention is to provide an improved method for accurately setting prefabricated doors or windows within a rough opening, which will provide centering and insure that the prefabricated unit placed therein will be solidly secured and free from binding at all points within the frame.

A further object of the invention is to provide an improved and simplified prefabricated door or window unit, which is enabled to be rapidly and correctly installed by an ordinary craftsman, at reduced labor and material cost.

Another object of the invention is to provide for a prefabricated door or window unit in which the double co-acting shim member is factory installed upon the prefabricated door or window casing.

It will be appreciated that various materials may be used for the shim structure, such as plastic wood composite, plastic, or wood, or the like.

These and other objects and advantages of the invention are achieved by the unique design and device of the present invention which resides in the permanent at factory application of a vertically mounted two-piece double wedge shim structure to the prefabricated door or window jamb which utilizes generally identical shim elements.

These, together with other objects and advantages which will become subsequently apparent reside in the details of construction and operation as more fully hereinafter described and claimed, reference being had to the accompanying drawings forming a part hereof, wherein like numerals refer to like parts throughout, and in which:

DETAILED DESCRIPTION OF THE DRAWINGS

Disclosed hereby is a double wedge type construction shim which is fastened to the framework of a prefabricated door or window by means of an integral mounting plate, which includes a fixed first shim, and a moveable second wedge shim which is slidingly interlocked with the fixed first wedge shim. Each wedge shim presents a tapered sloped contact face to complement and mate with the opposite wedge shim to provide an expandable shim surface to allow for the adjustment needed to provide a plumb door jamb or window with respect to the building. As herein shown, the parts are preferably formed of molded plastic, and have a slidable, interlocking snap-fit relation which is provided by a tongue and groove array, and a guide channel.

Figure 1:
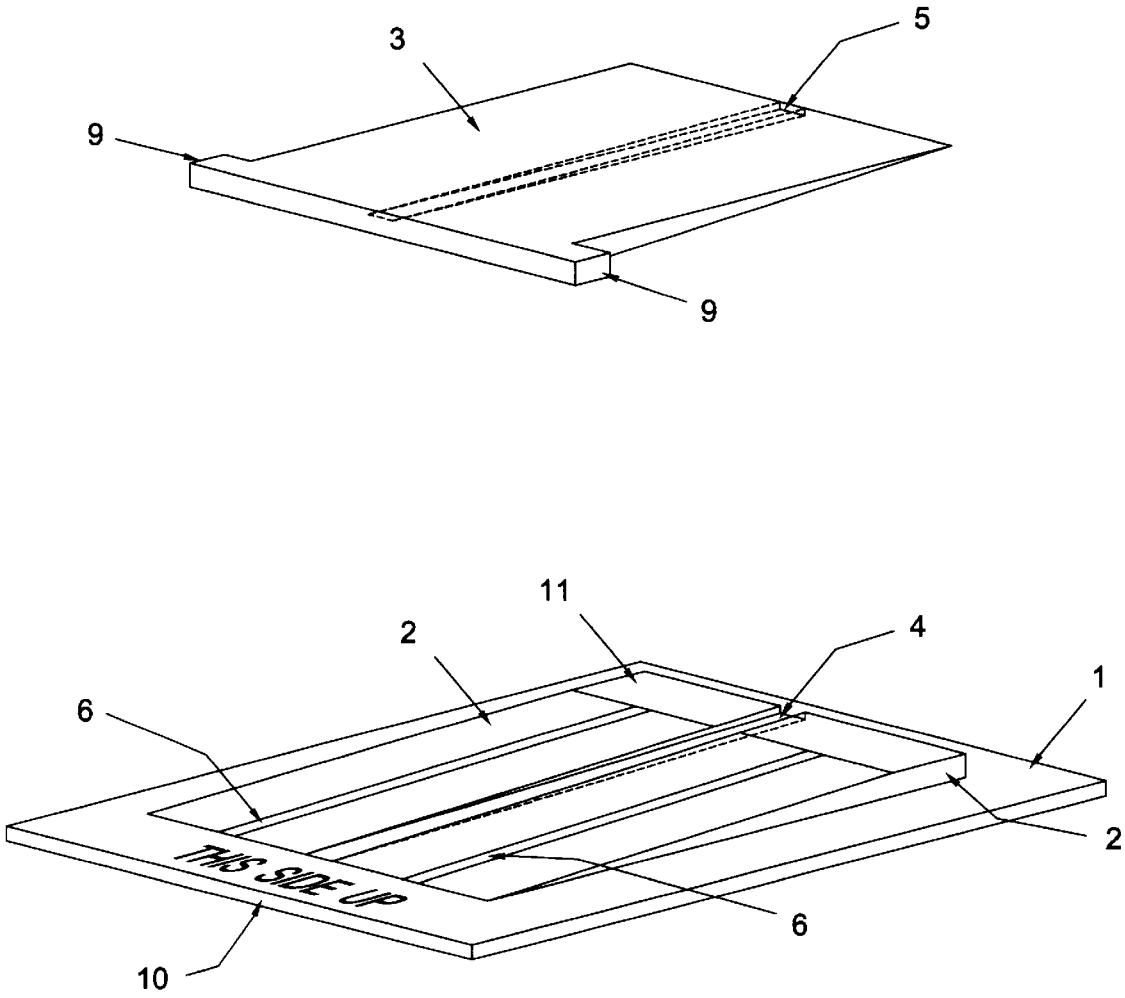
FIG. 1 Is an isometric exploded view of die double wedge shim system.
Figure 2:
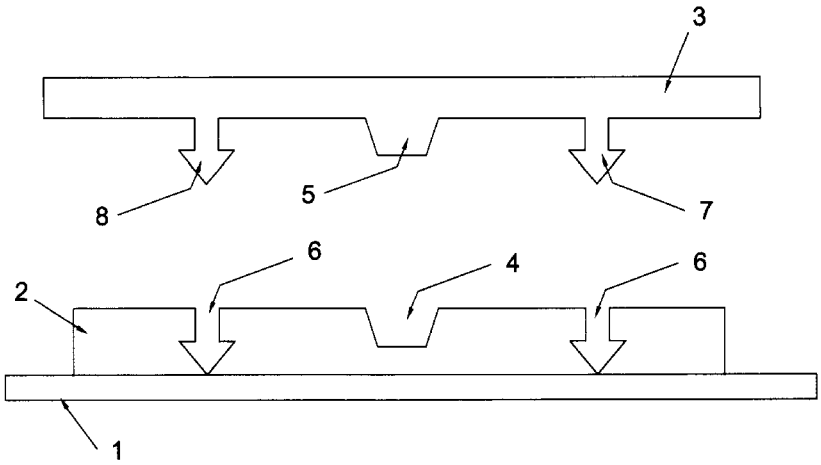
FIG. 2 Is an exploded view of the fixed wedge shim and mounting plate.
Figure 3:
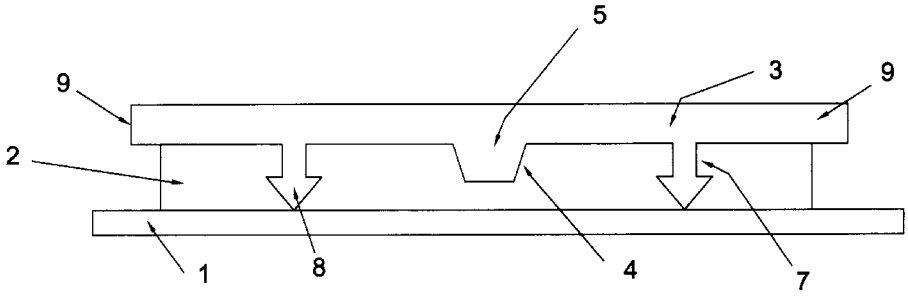
FIG. 3 Is a cutaway end view of die moveable wedge shim.
Figure 4:
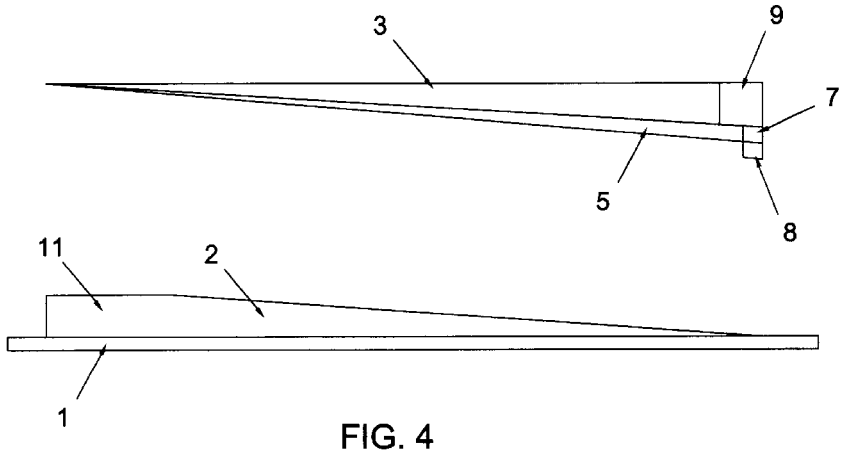
FIG. 4 Is a side view of the assembled wedge shim.
Figure 5:
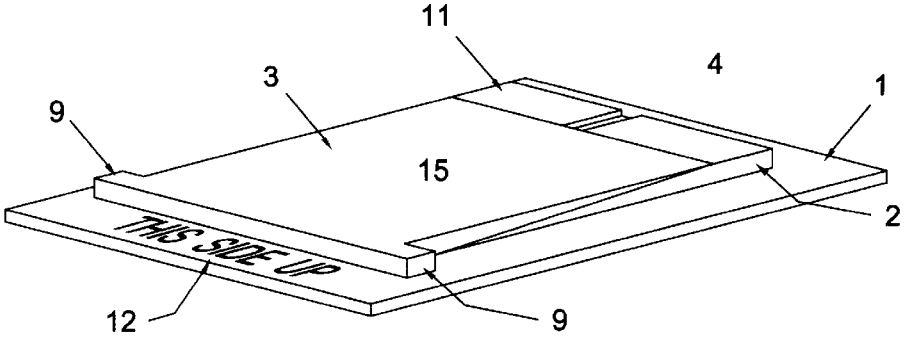
FIG. 5 Is an isometric top view of the assembled double wedge shim.
Figure 6:
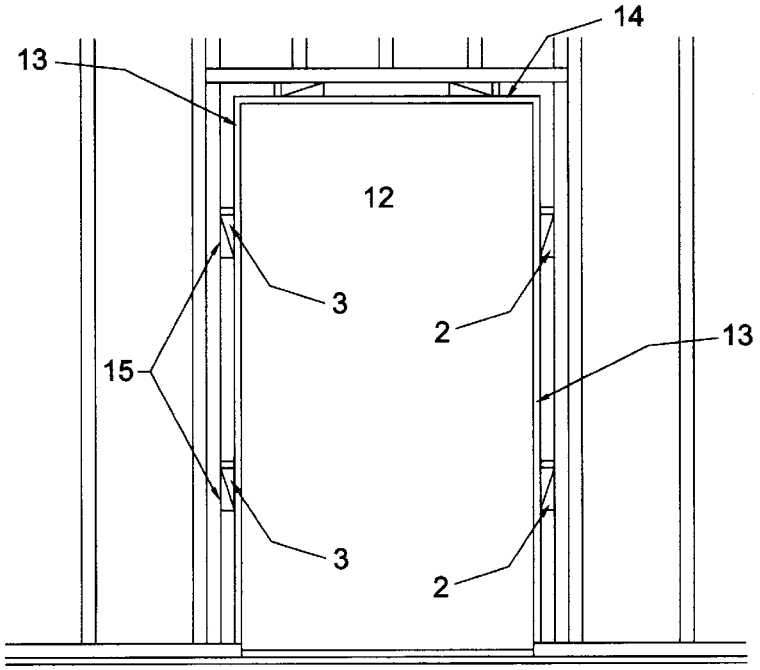
FIG. 6 Is a side view of a prefabricated door casing, illustrating preferred and directional placement of the assembled present invention.

With reference to the attached drawings, FIGS. 1–6, the double wedge type construction shim according to the present invention that is particularly useful in providing for an expandable shim surface is comprised of two separate and distinct parts, and is preferably permanently attached to a common prefabricated door casing or a prefabricated window framework. The prefabricated unit is generally of the common type found in new home or building construction, except that it includes an attached expandable shim surface according to the present invention. Prefabricated door or window units12 are generally furnished by the mill completely assembled with the door or window premounted, and the particular portions with which we are here concerned consist of the two side jambs 13 and the head jamb 14.

The fixed first shim member of the present double wedge type construction shim is represented herein generally as 2, the mounting plate portion identified as 1. The moveable second wedge shim is represented by the number 3. The moveable second wedge shim 3 is flanked at its thickened base by the finger tabs 9, and the first wedge shim 2 and the second wedge shim 3 interlock and fit together upon the mounting plate 1 to form the present double wedge construction shim 15 assembly.

The door unit 12, when preassembled for delivery to the jobsite, preferably has several of the assembled present shims 15 firmly held in place in their respective placements by means of common nails or staples which penetrate through the mounting plate 1 and into the door jambs 13 in the usual fashion. The present invention wedge shim structure is preferably affixed to the two side jambs 13 and the head jamb 14. In factory placement, the mounting plate 1 is attached with the thinner end of the fixed shim 2 uppermost, respective to the head jamb 14 of the door unit. However, the exact number and placements of the assembled wedge shim structure 15 is not here defined, as it is at the discretion of the manufacturer, with respect to the prefabricated door or window unit size and shape.

A central guide channel 4 is formed into die contact face of the fixed first shim 2. The guide channel 4 runs longitudinal and parallel to the contact face of the fixed shim 2. A corresponding channel follower 5 is formed atop the contact face of the moveable second wedge shim 3.

The fixed wedge 2 is provided with a duality of furrows 6 which reside adjacent to the guide channel 4 on the contact face of the fixed wedge 2. One or more snap-in locator/hold-down detent furrow runners, 7 which have a detent lug portion 8, are present upon the contact face of the moveable wedge 3. The moveable wedge 3 is assembled to reside atop the contact face of the fixed wedge 2, and the furrow runners 7 on the moveable wedge 3 fit into the furrows 6 present on the fixed wedge 2 contact face. The detent lug 8 interlockingly engages the furrows 6 when the fixed first shim 2 and the second moveable shim 3 are pressed together, to hold the two shims permanently and slidingly interlocked together. The guide channel 4, operating in conjunction with the furrows 6, and the furrow runners, 7 aligns and holds the moveable wedge 3 upon the fixed wedge 2, and permits controlled forward/reverse travel of the moveable wedge 3. The flattened face 11 of the fixed wedge 2 serves as a forward travel stop for the moveable wedge 3, as the furrow 6 stops at the flattened face 11.

It will be appreciated that various materials may be used for the present invention, such as plastic wood composite, plastic, or wood, or the like. In the present embodiment, the fixed wedge 2, ideally 3½ inches in width, is centered upon the mounting panel 1, and tapers in thickness from ⅜ inch at the base to 1/64 inch at the top. The tapered moveable wedge 3 is preferably 3½ inches in width, and tapers in thickness from ⅜ inch at the base to 1/64 inch at the top. The finger tabs 9 are attached to the thick end of the moveable wedge 3 and permit an installer to slide the moveable wedge 3 by hand or tool from either side of the installed door unit 12. The finger tabs 9 are equal in thickness to the thickened end of the moveable shim 3 and extend approximately ¼ inch beyond the moveable shim 3 perimeter, but do not extend past the mounting plate 1. The rectangular mounting plate 1 is preferably 4½ inches wide, 5 inches long, 1/16 inch in thickness throughout, and is permanently attached to the fixed wedge 2. The mounting plate 1 carries positioning identification markings 10, to assist in accurate factory placement. The fixed wedge 1 is attached so that its thin end is placed at the positioning identification marking 10 during manufacture.

Although the present invention has been described herein with particularity, relative to the foregoing detailed description of the preferred embodiment, i wish it to be understood that this description of the disclosed invention is done to fully comply with the requirements of 35 USC Sect. 112, and is not intended to limit the invention in any way. Various modifications, additions, and applications other than those specifically outlined herein will be readily apparent, without departing from the spirit and scope of my present invention, to those having ordinary skill in the art. In example, although the present invention is described herein as utilizing a mounting plate sized to fit a common prefabricated residential door casing, it is anticipated that a wider width plate, a widened double shim array or a site-applied shim array per die present invention could be employed as is known in the art, to allow for differing sizes, widths and shapes of prefabricated door/window units, or other articles of manufacture needing to be leveled and aligned within a rough opening. Accordingly, it is desired that the scope of my present invention be determined not entirely by die foregoing specification, and the embodiments illustrated, but that it be defined by the appended claims and their legal equivalents.

I claim:

1. An adjustable two-part wedge shim spacer, affixed in combination with a jamb of a prefabricated building closure, comprising:

a pair of tapered wedge shims comprising, a movable wedge shim and a fixed wedge shim each having a sloped face and two side faces and presenting a top contact face and a bottom face, each wedge shim lying against one another upon the contact face, with the sloped face of one said shim going in the direction opposite the other said shim, each said shim in telescopic cooperative relation with the other said shim, and the width of said shims approximate the width of said closure jamb; and a widened, flat, thin mounting plate permanently attached to the bottom face of the fixed wedge shim, the fixed wedge shim is centered longitudinally and latitudinally upon said mounting plate, and said mounting plate extends the fall width of said closure jamb, said mounting plate extends substantially beyond both ends of the length of said fixed wedge shim, and said mounting plate has directional mounting identification markings presented thereon; and a pair of finger tabs, extending at right angle to the side faces of the movable wedge shim, said finger tabs are located at the thickened end of said moveable wedge shim; and a parallel central guide channel, longitudinally extending the entire length of the contact face of the fixed wedge shim, and a complementary longitudinally extending parallel channel follower on the contact face of the movable wedge shim; and a duality of longitudinal guide furrows adjacent to said guide channel on the contact face of the fixed wedge shim, and correlative guide furrow followers on the contact face of the movable wedge shim, said guide furrow followers each have a lug portion projecting therefrom, and said guide furrow followers engage the guide furrows by a snap-fit interlocking coupling of the lug portions to hold the movable wedge shim overlapping the fixed wedge shim, wherein the movable wedge shim is slidably movable, and securely held upon the contact face of the fixed wedge shim.

2. The wedge shim spacer according to claim 1, wherein the wedge shim spacer is affixed completely intact onto the jamb of the prefabricated building closure during manufacture of the building closure.

* * * * *